United States Patent [19]

Lemongelli et al.

[11] Patent Number: 4,850,507

[45] Date of Patent: Jul. 25, 1989

[54] TRASH CONTAINER WITH DISPOSABLE BAGS

[76] Inventors: Ralph J. Lemongelli, Rte. 1, Monroe City, Mo. 63456; David T. Redman, Rte. 2, Palmyra, Mo. 63461

[21] Appl. No.: 197,625

[22] Filed: May 23, 1988

[51] Int. Cl.[4] ..... B65D 25/16

[52] U.S. Cl. ..... 220/407; 220/1 T

[58] Field of Search ..... 220/407, 404, 1 T

[56] References Cited

U.S. PATENT DOCUMENTS

| | | | |
|---|---|---|---|
| 3,392,825 | 7/1968 | Gale et al. | 206/47 |
| 3,451,453 | 6/1969 | Heck | 150/0.5 |
| 3,800,503 | 4/1974 | Maki | 206/58 |
| 4,319,694 | 3/1982 | Nehrbass et al. | 220/407 |
| 4,349,123 | 9/1982 | Yang | 220/1 T X |
| 4,364,490 | 12/1982 | Lang et al. | 220/407 |
| 4,577,778 | 3/1986 | Kim | 220/404 |
| 4,721,226 | 1/1988 | Yurko | 220/407 |

*Primary Examiner*—Steven M. Pollard

*Attorney, Agent, or Firm*—Litman, McMahon & Brown

[57] ABSTRACT

A refuse container conveniently self-stores a box of folded disposable liner bags in a manner which permits simple replacement of the box and liner bags.

7 Claims, 2 Drawing Sheets

TRASH CONTAINER WITH DISPOSABLE BAGS

BACKGROUND OF THE INVENTION

This invention is directed to trash or refuse containers adapted to self-store a box of disposable liner bags, and particularly to such a container which stores the box in a manner which permits simple replacement of the box and liner bags as needed.

OBJECTS OF THE INVENTION

The principal objects of the present invention are to provide a refuse receptacle wherein a box of disposable liner bags is easily put in place for dispensing bags within the receptacle; to provide such an arrangement wherein a group of liner bags contained within a storage box is easily stored in the bottom of the container for convenient withdrawal as needed; to provide such a combination wherein the stored liner bag box is easily mounted in a convenient position in the bottom of the container for automatic withdrawal of the bags; to provide such an arrangement wherein the liner bag container is retained in position by simple insertion longitudinally of the receptacle; to provide variations of the above arrangement wherein the folded bag-containing box may be inserted either from the receptacle opening in the top or from an appropriate opening in the bottom of the receptacle; to provide such an arrangement wherein the bag-containing box may be easily withdrawn and discarded when the bags are exhausted; and to provide such a container which is inexpensive to build, simple to use, and well adapted for its intended purpose.

Other objects and advantages of this invention will become apparent from the following description taken in conjunction with the accompanying drawings wherein are set forth, by way of illustration and example, certain embodiments of this invention.

SUMMARY OF THE INVENTION

The container contemplated in one preferred form involves a false bottom surrounding an opening through which folded bags are withdrawn from a bag-containing box secured in a cavity having walls peripherally surrounding the box. The walls forming the box receiving opening or cavity include tabs which retain the box against unwanted removal. Thus, in one form the box is inserted upwardly from the bottom and tabs prevent it from falling out if the trash receptacle is lifted off the ground. In another form, the box is inserted downwardly from the upper opening of the trash receptacle, and the box is retained in position by tabs when a folded bag is withdrawn therefrom. In either case, however, tabs allow an empty box to be removed easily by hand for replacement.

DESCRIPTION OF THE PREFERRED EMBODIMENTS

Figure 2:
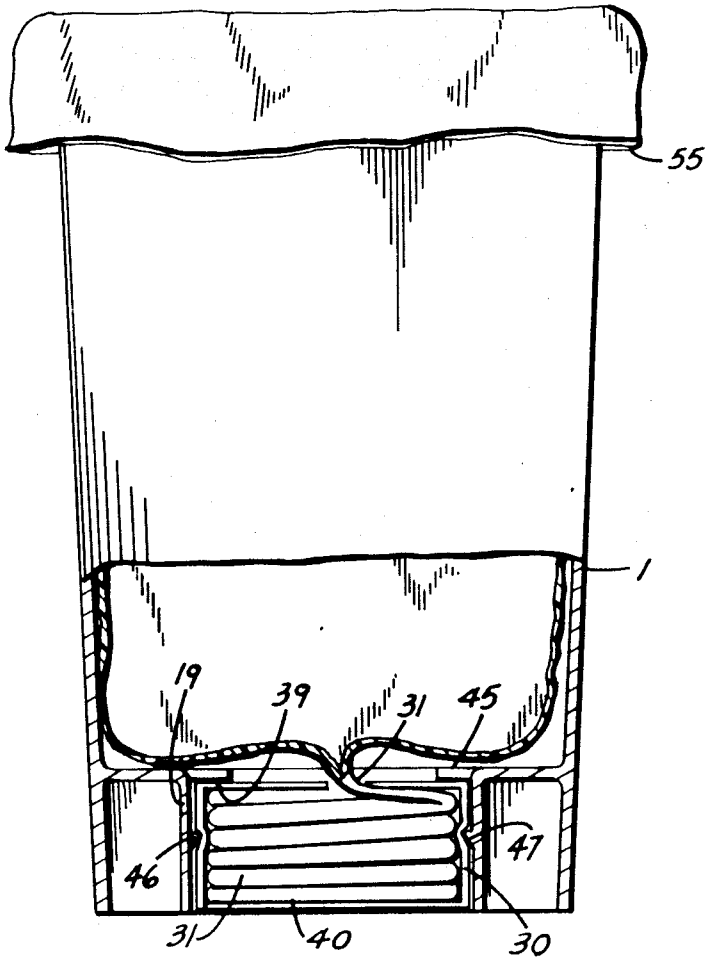
FIG. 2 is a side elevational view with portions broken away to reveal a bag box retained within a receiving cavity and a bag in place within the trash receptacle.
Figure 1:
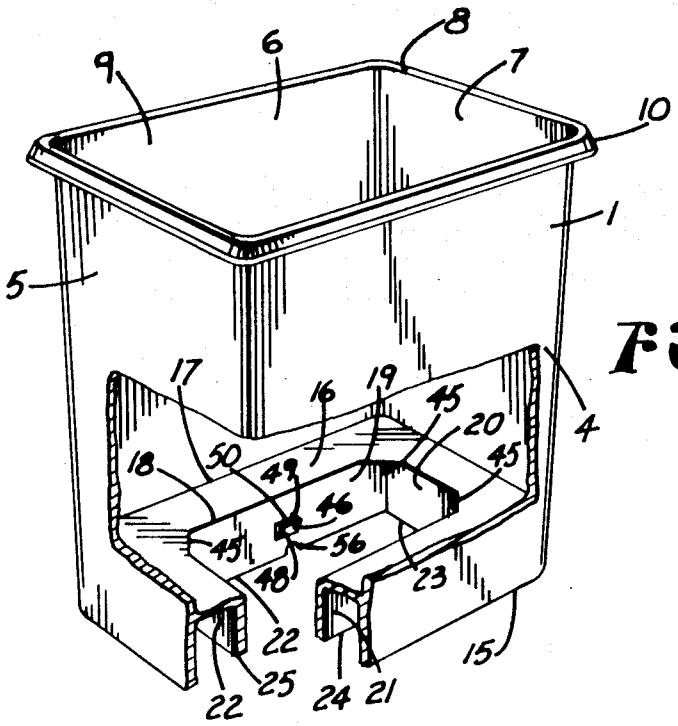
FIG. 1 is a perspective view of a trash receptacle embodying this invention with portions broken away to reveal interior construction.
Figure 3:
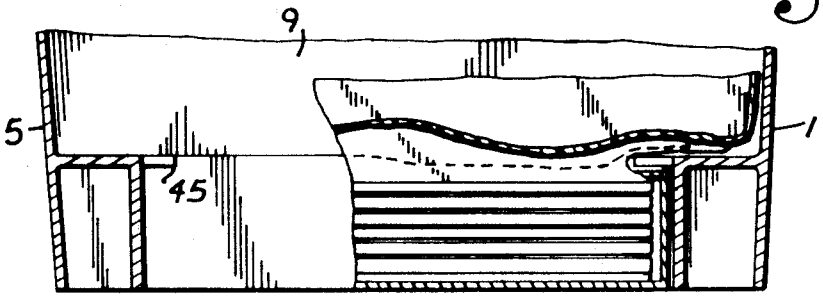
FIG. 3 is a fragmentary cross-sectional view taken longitudinally through the bag box and showing surrounding trash receptacle construction.

Referring to FIG. 1, an example of a trash receptacle 1 embodying this invention is shown having, in this instance, a conventional rectangular shape with upwardly and outwardly sloping walls 4, 5, 6, and 7 which terminate at upper edges 8 to form a rectangular receiving upper trash receiving opening 9. A curved lip 10 is preferably formed at the upper edges 8 to add structural rigidity to the receptacle and reduce the risk of injury or bag cutting through exposed sharp edges.

The receptacle may be fabricated of any suitable material, however, in this example, it is formed of molded synthetic resin allowing inexpensive construction.

The walls 4–7 terminate at lower edges 15 which, preferably, contact the surface upon which the receptacle rests and offer stable support.

In the embodiment of FIG. 1, a false bottom 16 is integral with, and projects horizontally inwardly from, the walls 4, 5, 6 and 7, producing a frame-like configuration with outer edges 17 and inner edges 18. At the inner edges 18, integral walls 19, 20, 21, and 22 depend and terminate at lower edges 22, 23, 24, and 25, generally at the same level as the lower edges of the outer walls 15. Preferably, the lower edges 22–25 are slightly recessed upwardly so that they do not tend to lift the lower edges 15 off the receptacle resting surface.

Figure 4:
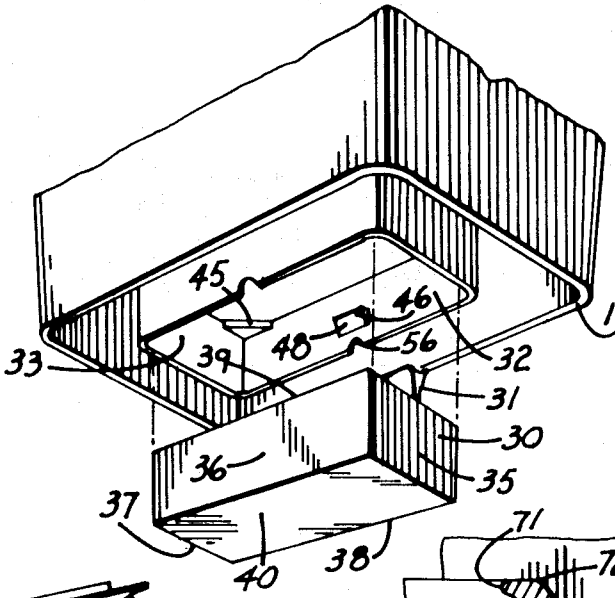
FIG. 4 is a fragmentary exploded perspective view showing the bag box aligned for insertion upwardly into the bottom of the trash receptacle.

The embodiment shown in FIGS. 1–4 may be termed a "bottom loading" arrangement, meaning that a box 30 which contains a plurality of folded bags 31 may be loaded, as shown in FIG. 4, by insertion upwardly into the cavity 32, formed by the walls 19–22, from the open bottom 33 as best shown in FIG. 4.

The box 30 has side walls 35, 36, 37, and 38, a top wall 39, containing an opening through which the bags are withdrawn, and a bottom wall 40 which supports the folded bags therewithin.

The corners formed by the joining of the respective vertical walls 19, 20, 21, and 22, are partially covered by corner projections 45, which prevent the corners formed by the box walls 35, 36, 37, and 38, at the upper wall 39, from moving upwardly into the trash receiving interior of the receptacle.

Tabs 46 and 47, in this embodiment, project outwardly from the vertical walls 19 and 21 and are suitably positioned to engage the walls 36 and 38 of the box 30 when it is inserted into the cavity 32, FIG. 4. The tabs 46 and 47 have walls 48 which slope upwardly and inwardly, joining generally horizontal top walls 49. The walls 48 and 49 produce a relatively sharp edge 50.

When the box 30 is inserted, the tab sloping walls 48 compress the box walls 36 and 38 inwardly as the box slides upwardly within the cavity. However, the elasticity of the box walls 36 and 38 urge the surfaces thereof against the sharp edge 50 and tend to dig in and grasp same so that the box 30 will not fall out, either from its own weight or due to rough handling of the receptacle with the box contained therein.

After the box is inserted, the top of a bag 31 may be easily grasped and withdrawn upwardly past top wall 45 and expanded within the receptacle in the usual manner, normally by pulling the bag upper edge 55 downwardly over the upper edges 8 of the receptacle walls, covering the upper edge and interior surfaces of the container. Perforations or other weakening systems (not shown) allow the old and new bag to be easily separated.

When the bag is full of refuse (not shown), the upper edge 55 of the bag may be gathered in the usual manner, tied, and the bag lifted out of the receptacle for disposal. The act of withdrawing the full bag automatically pulls the next bag upwardly for replacement and use within the container.

When the box 30 is empty of bags, it may be grasped by the fingers through appropriate finger notches 56, formed at the bottom edge of the vertical walls 19 and 21, and pulled downwardly away from the receptacle for discard and replacement.

Figure 6:
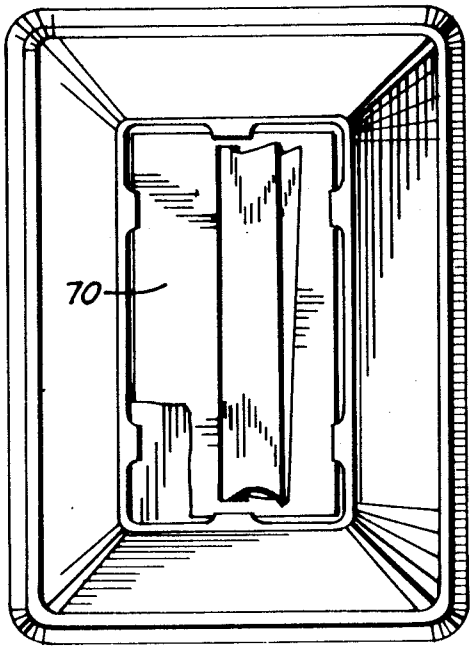
FIG. 6 is a plan view of the form of the receptacle shown in FIG. 5.
Figure 7:
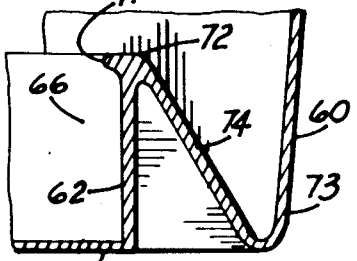
FIG. 7 is a fragmentary cross-sectional view providing further details of the form of the receptacle shown in FIG. 5.
Figure 5:
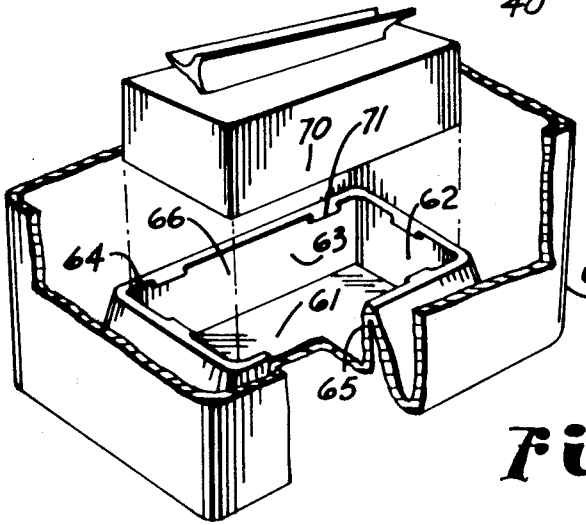
FIG. 5 is a fragmentary perspective exploded view of a modified form of this invention wherein the bag box is shown in position to be loaded downwardly from the open top of the receptacle.

An alternate preferred embodiment of this invention is illustrated in FIGS. 5–7 and may be referred to as a "top loader". In this embodiment, best illustrated in FIG. 5, the receptacle 60 has a closed bottom wall 61 which is integral with upwardly extending side walls 62, 63, 64 and 65 which form a cavity 66 for receiving the folded bag-containing box 70. Inwardly directed tabs or projections 71 are spaced about the upper edges 72 of the walls 62–65 and form obstructions which frictionally retain the box 70 within the cavity 66 so that it will not be pulled out upwardly upon upward withdrawal of a bag to replace a prior bag. The projections 71, however, are not sufficiently obstructive to prevent grasping and removal of the box upwardly by hand for replacement with a full box.

The bottom wall 61 and side walls 62–65, in this example, are integrally attached to the container side walls 73 by a sloping intermediate wall 74, whereby the container has a fully closed bottom whereupon the receptacle will contain liquids, unlike the first embodiment described.

Although certain embodiments of this invention have been illustrated and described, it should be understood that the scope of this invention is not to be limited thereto, except insofar as such limitations are included in the following claims.

What is claimed and desired to be secured by Letters Patent is as follows:

1. A trash receptacle adapted to be lined by disposable bags that are fed one at a time from a box of folded bags into the receptacle, the combination comprising:

(a) side walls forming an upper trash receiving opening and having lower edges, a bottom wall integral with said side walls;

(b) upwardly extending walls spaced inwardly of said side walls, said upwardly extending walls being integrally connected to said bottom wall and forming a folded bag box-receiving cavity; and (c) tabs projecting inwardly from said upwardly extending walls, said tabs being adapted to engage said box and prevent same from freely exiting said cavity.

2. The receptacle arrangement as set forth in claim 1 wherein:

(a) said cavity opens downwardly.

3. The receptacle arrangement as set forth in claim 2 wherein:

(a) said upwardly extending walls include finger notches at lower edges thereof for grasping said box.

4. The receptacle arrangement as set forth in claim 1 wherein:

(a) said cavity opens upwardly.

5. The receptacle arrangement as set forth in claim 4 wherein:

(a) said upwardly extending walls are connected to said bottom wall through sloping, integral intermediate walls.

6. The receptacle arrangement as set forth in claim 1 wherein:

(a) said upwardly extending walls are connected to said bottom wall near said lower edges.

7. A trash receptacle adapted to be lined by disposable bags that are fed one at a time from a folded bag-containing box into the receptacle from its bottom, the combination comprising:

(a) side walls and an integral bottom wall forming a trash receptacle; said bottom wall being elevated above the lower edges of said side walls;

(b) said bottom wall projecting inwardly from said side walls and terminating in a frame edge forming an interior opening;

(c) inner walls integral with said bottom wall at said frame opening and depending downwardly therefrom; said inner walls forming a vertically open box-receiving cavity;

(d) tabs projecting inwardly from said inner walls; and (e) said box of bags being vertically received in said cavity, said tabs being positioned to engage said box and resist vertical removal of said box from said cavity.

* * * * *